US005078826A

United States Patent [19]

Rogall

[11] Patent Number: 5,078,826

[45] Date of Patent: Jan. 7, 1992

[54] LABELLING MACHINE FOR THE LABELLING OF CONTAINERS

[75] Inventor: Wolfgang Rogall, Wuppertal, Fed. Rep. of Germany

[73] Assignee: ETI-TEC Maschinenbau GmbH, Erkrath, Fed. Rep. of Germany

[21] Appl. No.: 431,587

[22] Filed: Nov. 3, 1989

Related U.S. Application Data

[63] Continuation-in-part of Ser. No. 197,653, May 23, 1988, and a continuation-in-part of Ser. No. 260,787, Oct. 21, 1988, and a continuation-in-part of Ser. No. 315,885, Feb. 24, 1989.

[30] Foreign Application Priority Data

Nov. 3, 1988 [DE] Fed. Rep. of Germany ..... 3838202
Aug. 18, 1989 [DE] Fed. Rep. of Germany ..... 3927296

[51] Int. Cl.[5] ..... B65C 9/04

[52] U.S. Cl. ..... 156/451; 156/447; 156/448; 156/564; 156/565; 156/567; 156/573; 156/578

[58] Field of Search ..... 156/567, 578, 564, 565, 156/573, 447, 448, 451, 458, 456, 452, 453

[56] References Cited

U.S. PATENT DOCUMENTS

| | | | |
|---|---|---|---|
| 589,673 | 9/1897 | Simmons | 156/453 |
| 900,114 | 10/1908 | Morral et al. | 156/453 |
| 1,118,734 | 11/1914 | Brownson | 156/564 X |
| 2,060,788 | 11/1936 | Brautigam | 156/565 X |
| 3,045,643 | 7/1962 | Mattingly et al. | 118/415 |
| 3,183,138 | 5/1965 | Mattingly et al. | 156/573 X |
| 3,560,303 | 2/1971 | Nelson | 156/453 |
| 4,276,333 | 6/1981 | Cobean | 156/578 X |
| 4,283,245 | 8/1981 | Benoit | 156/476 |
| 4,306,926 | 12/1981 | Pfulb | 156/215 |
| 4,430,141 | 2/1984 | Zodrow | 156/360 |
| 4,445,961 | 5/1984 | Kronseder et al. | 156/364 |
| 4,512,842 | 4/1985 | Schneider | 156/357 |
| 4,531,995 | 7/1985 | Gau | 156/564 X |
| 4,594,123 | 6/1986 | Eder | 156/456 |

FOREIGN PATENT DOCUMENTS

| | | |
|---|---|---|
| 3102950 | 1/1982 | Fed. Rep. of Germany . |
| 3613317 | 10/1987 | Fed. Rep. of Germany . |

*Primary Examiner*—David A. Simmons
*Assistant Examiner*—J. Sells
*Attorney, Agent, or Firm*—Nils H. Ljungman & Associates

[57] ABSTRACT

A labelling machine for cylindrical containers which are moved past a labelling station by a rotary table and which rotate past the front side of a label stack and thereby remove a front side label. A hot adhesive is sprayed onto the container by a first adhesive unit. During the rolling of the container past the label stack, a label is adhered to the front edge of the container. The rear edge of the label has adhesive applied by a second adhesive unit which is located near the labels which are stored in the stack. In order to make possible a change between different container formats, the label box, the first adhesive unit and the second adhesive unit are mounted on a common sliding carriage. The sliding carriage is a translatable in the direction of the rotary table and is pretensioned in the direction of the rotary table by a spring against a stop.

4 Claims, 5 Drawing Sheets

LABELLING MACHINE FOR THE LABELLING OF CONTAINERS

CROSS-REFERENCE TO RELATED APPLICATIONS

The present application is a contunuation-in part of U.S. patent applications Ser. No. 07/197,653 U.S. Pat. No. 4,944,830, entitled, "Drive For A Rotary Plate In A Labelling Machine For Bottles", Ser. No. 07/260,787 U.S. Pat. No. 4,911,285, entitled, "Machine For Labelling Bottles" and Ser. No. 07/315,885, U.S. Pat. No. 4,950,350, entitled, "Machine For Labelling Bottles Or The Like."

BACKGROUND OF THE INVENTION

1. Field of the Invention

The present invention relates to a labelling machine for labelling circular cylindrical containers or the like. Included is a rotary table having angularly controlled receiving positions for the containers positioned on the edge of the rotary table. A labelling station is located on the periphery of the rotary table and includes a labelling box for maintaining and dispensing a stack of labels. Each passing container removes a front label from the label box as it rolls by on a rotation controlled receiving position. A first adhesive unit is sensor controlled and applies adhesive to each container as the container moves by. There is also provided a second adhesive unit, which acts on the rear edge of the front label located in the label box.

2. Description of the Prior Art

Similar labelling machines are known. Primarily, they are used to perform so-called "all around labelling". Generally, with this type of labelling machine, the first adhesive unit sprays hot glue onto the container as soon as the sensor, which is attached to the adhesive unit., detects that there is a container within the effective area of the adhesive unit. The rotational movement of the receiving positions on the rotary table is arranged and controlled in such a manner that each container, with its adhesive area, meets the label front edge and, by means of adhesion of the adhesive, removes the front label from the label stack during its transport movement past the rotary table. The glue for the rear edge is applied by the second adhesive unit and is pressed into place by a stationary pressure element, during the transport of each container on the rotary table.

An accurate positioning of the labelling boxes and the adhesive units around the circumference of the rotary table is a very necessary prerequisite for trouble free labelling of the containers. This is normally done by taking into consideration the format of the containers to be labelled.

The quality of the labelling depends, to a considerable degree, on the accurate positioning of the labelling box. Since the container rolls past while removing the label, special attention must be paid to the adjustment of the label box. Inaccuracies can occur, even if large tolerances are acceptable within the same format. The faulty feeding of a label having a larger format can even cause damage to the labelling station.

OBJECTS OF THE INVENTION

One object of the present invention is to simplify the changeover of the labelling machine from one format to another format of containers.

An additional object of the present invention is the provision of a labelling box mounting apparatus in which accurate adjustments are less critical to assuring acceptable performance.

SUMMARY OF THE INVENTION

These and other objects are achieved by providing that the labelling box and the first adhesive unit, which is equipped with a sensor, as well as the second adhesive unit, are mounted on a common sliding carriage. This sliding carriage is located on a support which is movable in the direction of the rotary table. The sliding carriage is located in that direction and has an adjustable striker stop which is pretensioned by a spring. Preferably, the support is also laterally adjustable.

In order to accomplish a quick and accurate changeover to another container diameter, with a labelling machine constructed according to the present invention, only one adjustment step is required for the elements which participate in the labelling, that is, the labelling box and the adhesive units. Variations in the diameter of the containers being labelled can be handled by the labelling station without difficulty, due to the fact that the entire unit, which is mounted on and which can be moved with the sliding carriage, can be moved towards the containers to be labelled against the tension of the spring. Therefore, an adjustment can be made, whereby, even if the containers are located within a lower tolerance limit, the rolling motion on the front label will assure an optimal transfer.

Similarly, the changeover to another container height requires but a singular adjustment to the laterally adjustable support.

The alignment of the labels, both about the container as well as with respect to the vertical axes of the containers, can be easily accomplished with the invention, due to the fact that the support is provided with a rail which serves as a guide for the sliding carriage. Additionally, and preferably, the sliding carriage can be tilted, and also has an adjustable support element which limits the extent of the tilted position.

Preferably, a labelling machine should accommodate labels of different lengths, a requirement imposed when labelling containers of different dimensions in an "all around label" machine. In the present invention, this can be accomplished due to the fact that the second adhesive unit is preferably mounted on an additional sliding carriage, which is, in turn, mounted on the first sliding carriage in a lateral manner.

One aspect of the invention resides broadly in a labelling machine for attaching a label to a container or the like, the labelling machine comprising: a rotary turntable, the rotary turntable having an arrangement for positioning a container thereon; a labelling station positioned adjacent the periphery of the rotary turntable, the labelling station comprising: a carriage member, the carriage member being translatable with respect to the rotary turntable in a direction towards the periphery of the rotary turntable; a label container device for containing and dispensing a label, the label container device being mounted on the carriage member and translatable in the direction towards the periphery of the rotary turntable therewith; and a biasing arrangement for biasing the carriage member in the direction towards the periphery of the rotary turntable.

Another aspect of the invention resides broadly in a labelling station for use in conjunction with a labelling machine for attaching a label to a container or the like, the labelling machine comprising a rotary turntable, the rotary turntable having a device for positioning the container thereon, the labelling station for being positioned adjacent the periphery of the rotary turntable and including: a carriage member, the carriage member being translatable with respect to the rotary turntable in a direction towards the periphery of the rotary turntable; a label container arrangement for containing and dispensing the label, the label container arrangement being mounted on the carriage member and translatable in the direction towards the periphery of the rotary turntable therewith; and a biasing device for biasing the carriage member in the direction towards the periphery of the rotary turntable.

BRIEF DESCRIPTION OF THE DRAWINGS

We turn now to a detailed description of a preferred embodiment of the invention, after first briefly describing the drawings, wherein.

DESCRIPTION OF A PREFERRED EMBODIMENT

Figure 1:
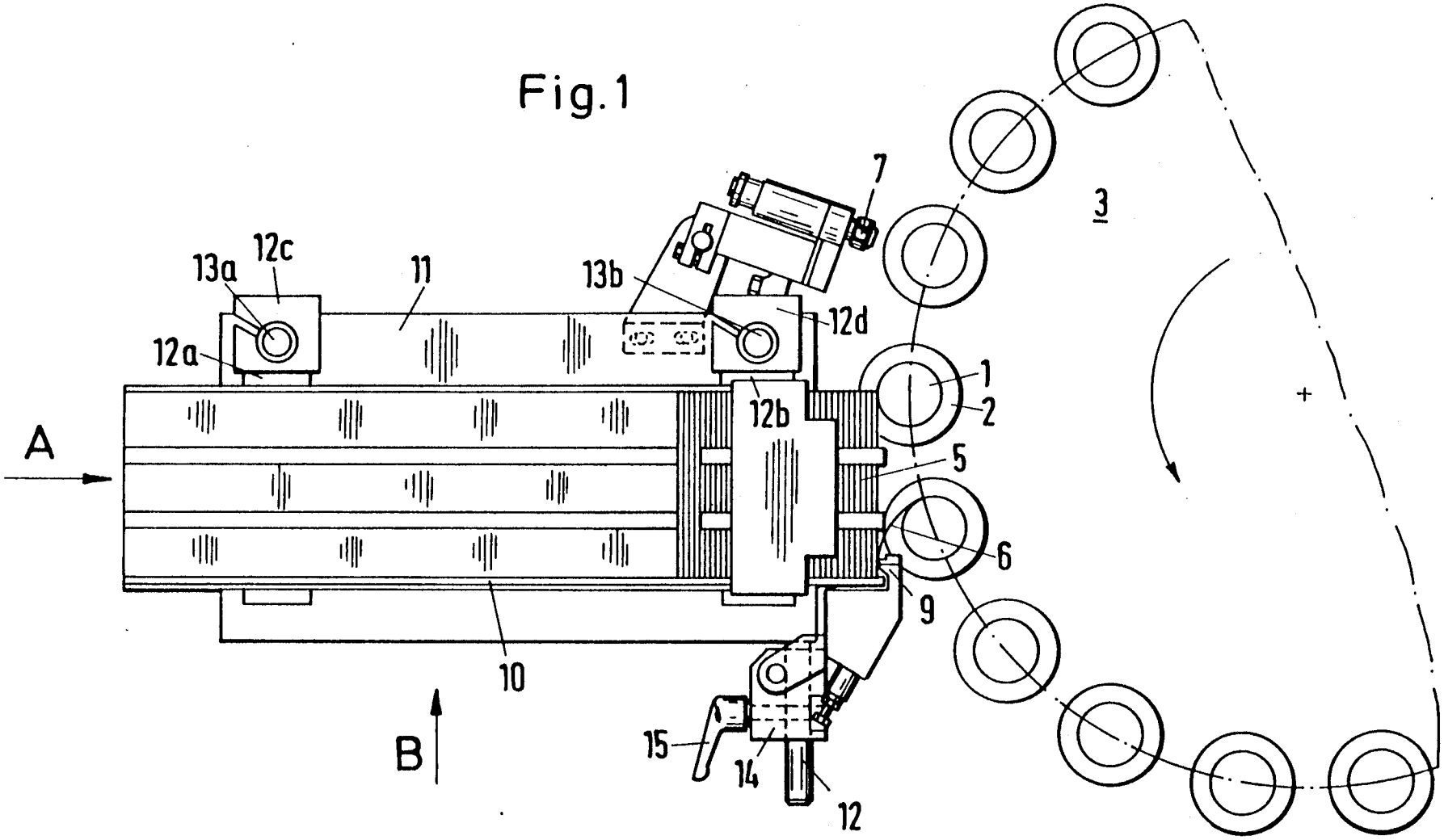
FIG. 1 is a top plan view of a labelling machine, constructed according to the present invention, with the labelling station thereof being shown in partially sectional view.
Figure 2:
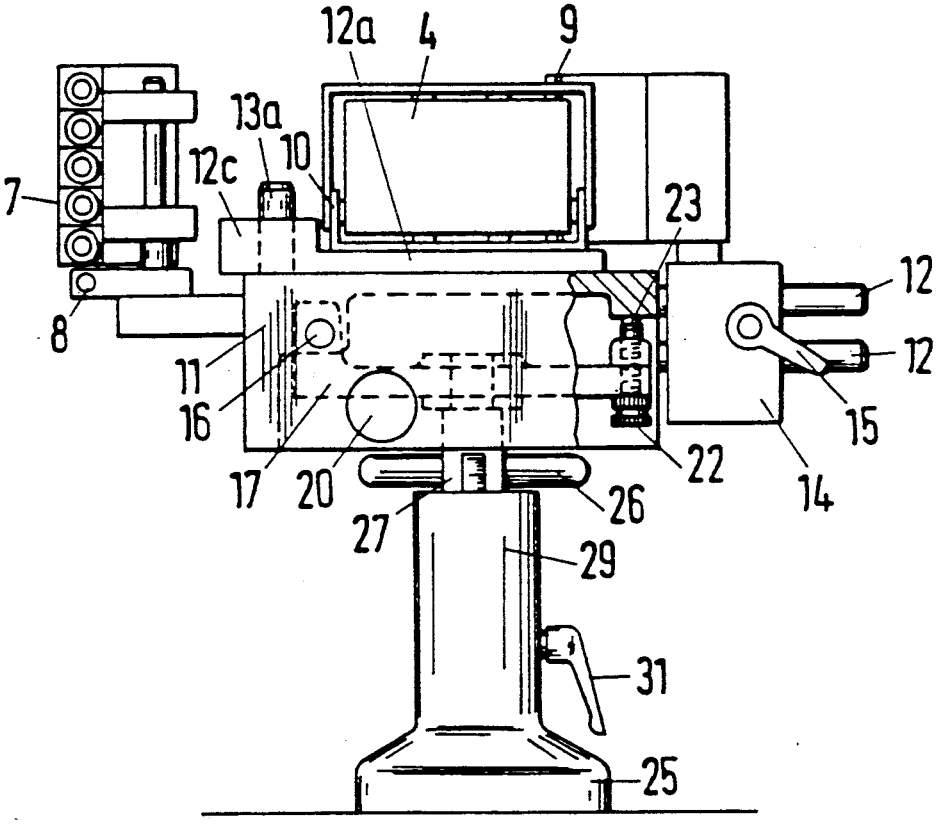
FIG. 2 is an elevational view of the labelling station from the view of arrow A in FIG. 1.
Figure 3:
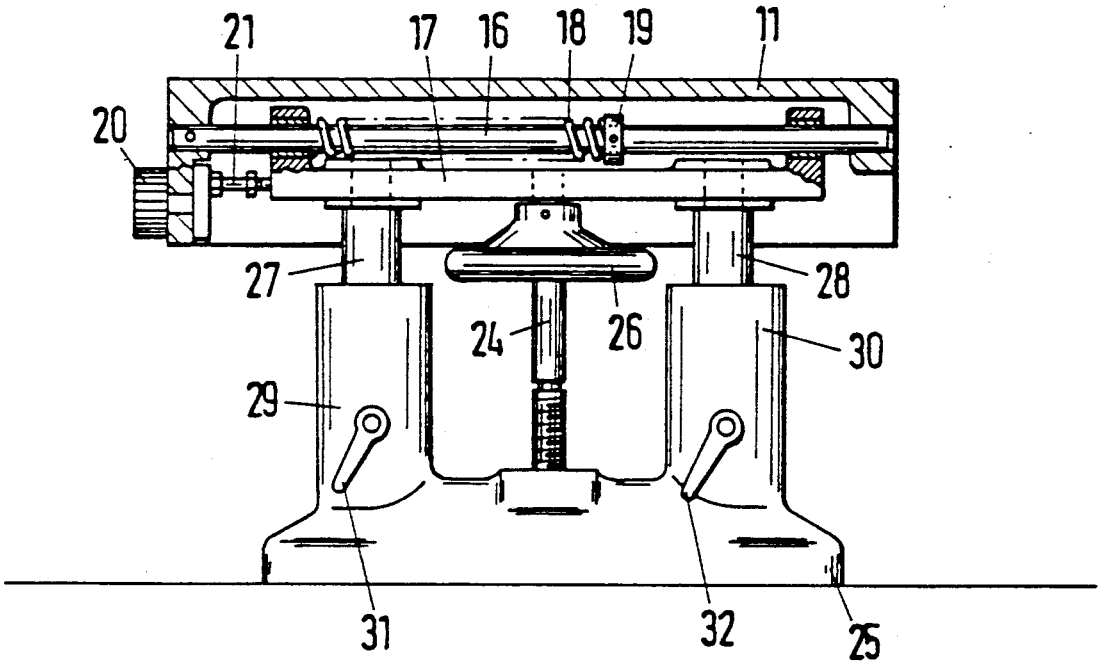
FIG. 3 is an elevational view of the lower part of the labelling machine according to FIG. 1, partially in cross-section, and partially with a view point from the view of arrow B in FIG. 1.

Referring now to FIGS. 1-3, a bottle 1 which is to be labelled is located in a receiving position 2 of a rotary table 3. The bottle 1 is to be transported past a labelling station 4 via rotary table 3. Rotary table 3 moves bottles 1 past a stack of labels 5, preferably with a spinning motion which rolls them past the frontal side of the stack of labels 5, at which point a front label 6 is removed and wrapped around bottle 1. Label station 4 is provided with an adhesive unit 7, which is located in the path of travel of the bottles 1, but ahead of labelling station 4, and which consists of a vertically arranged row of spray nozzles for a hot adhesive. With the help of a sensor 8, which is preferably located in the same row, it is determined if there is a bottle 1 within the effective area of adhesive unit 7. If such is in fact the case, then adhesive unit 7 is activated and sprays adhesive onto bottle 1. Following the application of the adhesive, bottle 1 is transported through the receiving position 2, and is preferably spun during its transport, in such a manner that the adhesive surface meets with the front edge of the label box 5, and thereafter rolls along label box 5, in such manner that the front label 6 is removed by the adhesive effect.

For the application of an adhesive to the rear edge of label 6 contained in label stack 5, there is provided an additional adhesive unit 9, the nozzles of which are locked into position adjacent the front side of label stack 5. This adhesive application occurs during the removal of label 6 from label stack 5. There is also provided a pressure element positioned adjacent the transport route, which pressure element presses the rear edge of the removed label 6 against the bottle 1 during the continued movement of the rotary table 3.

Label stack 5 is contained within a label box 10, which is mounted on two carrier rails 12*a* and 12*b*. The two carrier rails 12*a* and 12*b* are equipped with side mounted clamping elements 12*c* and 12*d* which can be fixedly clamped to sliding carriage 11 by means of pegs 13*a* and 13*b*. In this fashion, labelling boxes of different dimensions can be mounted on sliding carriage 11.

Sliding carriage 11 also carries first adhesive unit 7, including its sensing unit 8, as well as second adhesive unit 9, which performs the rear edge adhesion application. Second adhesion unit 9 is fastened to a sliding carriage 14 and is slidably mounted on guide rails 12. Second adhesion unit 9 can be fixedly positioned on guide rails 12 by means of a clamping lever 15. The lateral sliding movement of adhesive unit 9 serves to permit adjustment for labels of various lengths.

Sliding carriage 11 carries the following items: label box 10, first adhesive unit 7 with its sensing unit 8 and sliding carriage 14, upon which is mounted second adhesive unit 9. Sliding carriage 11 is also provided with a longitudinal guide rail 16, which allows sliding carriage 11 to be moved towards and/or away from rotary table 3.

In one preferred embodiment, sliding carriage 11 is translatable along a line substantially perpendicular to a tangent to the path of travel of bottles 1. A coiled spring 18 is located on guide rail 16 and is braced, on one side, against an abutment 19, provided on guide rail 16, and on the other end, is braced against a support 17, in such a way that sliding carriage 11 is preloaded by spring 18 in the direction of rotary table 3. The positioning of sliding carriage 11, with respect to rotary table 3, is determined by an adjustable adjustment knob 20, which adjusts the positioning of a stop 21. Based on this mounting and the biasing force of spring 18, sliding carriage 11 can move away from rotary table 3, in response to pressure against the front side of label stack 5 and as a result of a compression of spring 18.

Guide rail 16 simultaneously serves as a tiltable bearing mount for sliding carriage 11. As seen most clearly in FIG. 2, opposite guide rail 16, sliding carriage 11 is braced against a support element 23 which is mounted on a support 17, and the vertical positioning of which can be altered by an adjustment knob 22, thus permitting adjustment of the degree of lateral tilt of sliding carriage 11. Sliding carriage 11 rests on support element 23, which can be adjusted by knob 22 and which is located on support 17. Sliding carriage 11 rests on support element 23 by its own weight.

Support 17 is carried by an adjustable spindle 24, which in turn is braced on a pedestal 25. Spindle 24 can be adjusted by means of an adjustment wheel 26 to thereby adjust the height of support 17. Support 17 is equipped with two guide columns 27 and 28 which are located within guide tubes 29 and 30. After the selection of the desired height of support 17, by means of adjustable spindle 24, guide columns 27 and 28 can be clamped within guide tubes 29 and 30 by means of clamping elements 31 and 32.

Figure 4:
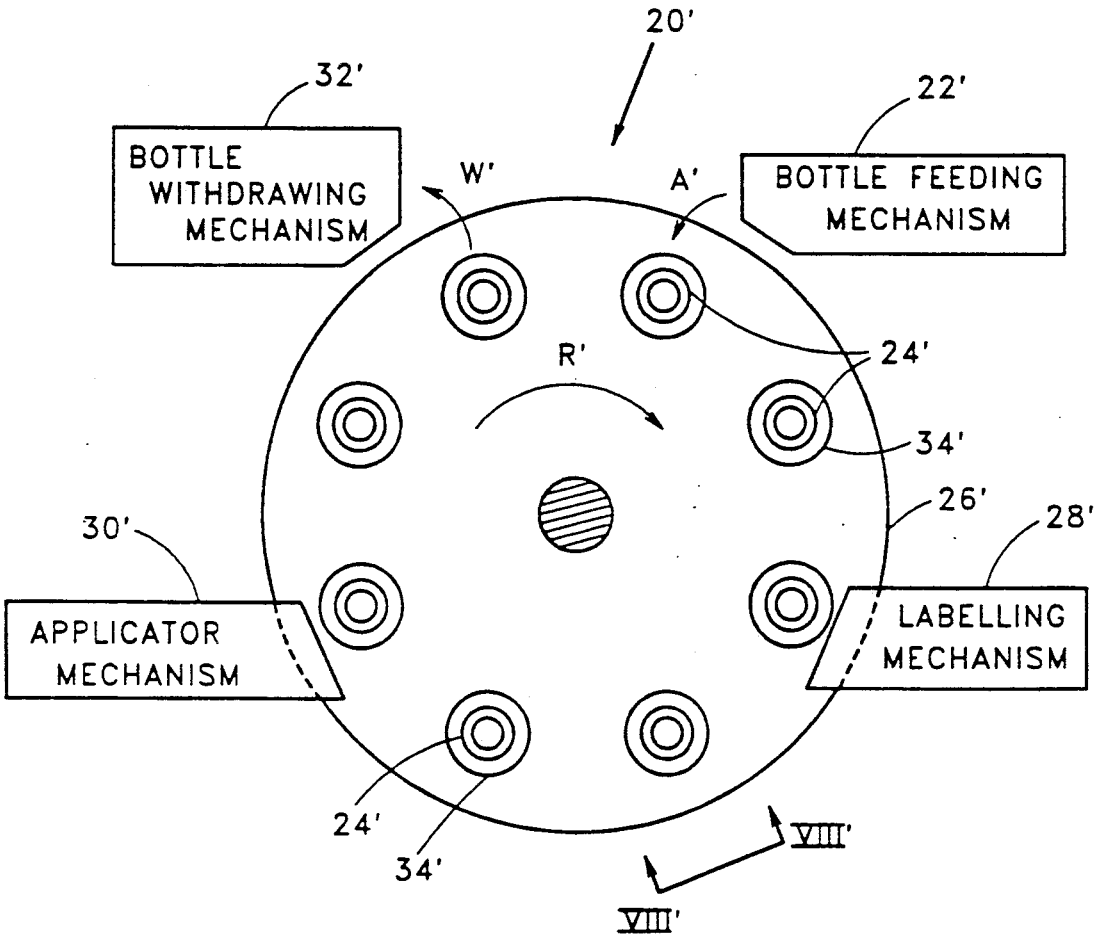
FIG. 4 shows a schematic top view of a labelling machine including various features of the invention.
Figure 5:
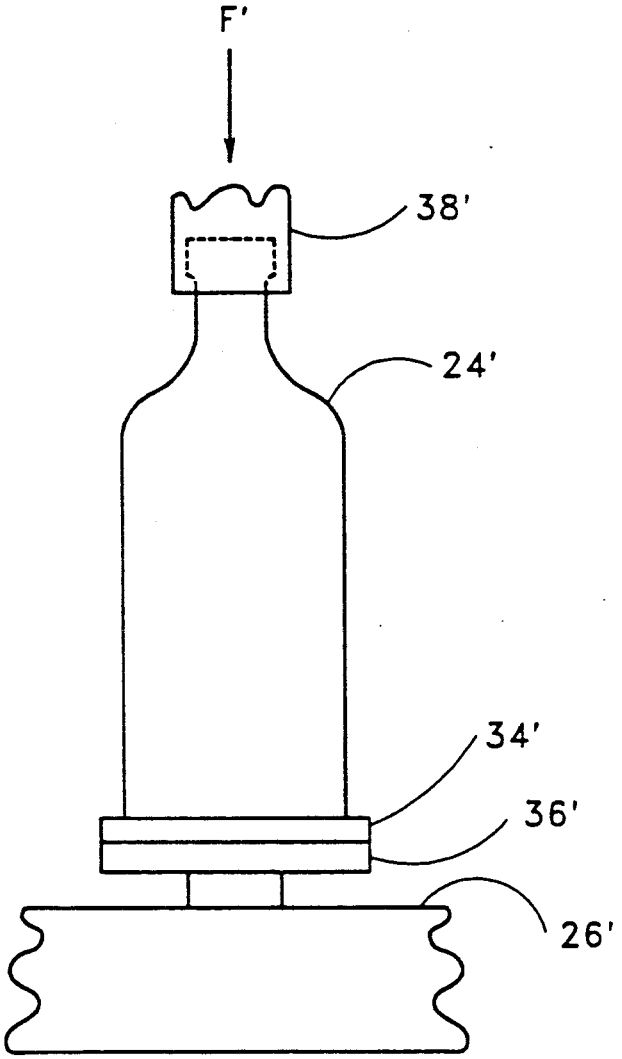
FIG. 5 shows a schematic, view of the machine of FIG. 4 as seen along Line VIII—VIII.

As seen in FIGS. 4 and 5, a typical labelling machine 20' is shown in schematic form. Typically, such labelling machines 20' include a bottle feeding mechanism 22' for advancing the bottles 24' as indicated by the arrow A'. The bottles 24' are sequentially positioned by the bottle feeding mechanism 22' on a revolving bottle support platform 26' for advancement in a direction as indicated by the arrow R' to a labelling mechanism 28'. After a label is applied to the bottle 24' by the labelling mechanism 28', continued rotation of the platform 26' in the direction R' advances the bottle 24' to an applicator mechanism 30' which insures that the label is properly pressed and applied to the surface of the bottle 24'. Continued revolution of the bottle support platform 26' causes the bottle 24' to be directed to a bottle withdrawing mechanism 32' for removal of the bottles 24' from the revolving platform 26' as indicated by the arrow W'.

As best seen in FIG. 5, each bottle 24' is initially positioned on a support plate 34' of the revolving platform 26'. Specifically, the support plate 34' is mounted on a bottle turntable 36' which is adapted for controlled movement of the bottle 24' relative to the revolving platform 26'. Although not shown in FIG. 4, it can be seen in FIG. 5 that, after initial positioning of the bottle 24' on the support plate 34', an upper support mechanism 38' is lowered against the top of the bottle 24' to produce a downward force F' thereon as the bottle proceeds to the labelling mechanism 28' and the applicator mechanism 30'. The upper support mechanism 38' is retracted prior to removal of the bottle 24' from the platform 26' at the bottle withdrawing mechanism 32'.

In summary, one feature of the invention resides broadly in a labelling machine for circular cylindrical containers 1 which includes a rotary table 3, and on the edge of the rotary table, are rotary controlled receiving positions 2 for the containers 1. Labelling station 4 is located on the periphery of the rotary table 3 and is provided with a label stack 5, which is contained in a label box 10. A label 6 is located on the front side of label box 10, and every container 1 removes a label 6 from the label box, as it rolls by the rotation controlled receiving position 2. Ahead of label box 10, controlled by sensor 8, is the first adhesive unit 7, which applies adhesive to every container 1 which rolls by, as well as a second adhesive unit 9, which applies adhesive to the rear edge of label 6 located in label box 10 is characterized by the fact that the labelling box 10, the first adhesive unit 7, with its sensor 8, and the second adhesive unit 9 are mounted on a common sliding carriage 11, slideable in the direction of rotary table 3, which is pretensioned by means of a spring 18 against an adjustable stop 21.

Another feature of the invention resides broadly in the labelling machine which is characterized by the fact that the height of the support 17 is adjustable.

A further feature of the invention resides broadly in the labelling machine characterized by the fact that the support 17 has a rail 16 for a sliding carriage 11, which sliding carriage 11 can be tilted and has an adjustable set screw 23 which limits the tilting position.

Yet another feature of the invention resides broadly in the labelling machine characterized by the fact that the second adhesive unit 9 is positioned on an additional sliding carriage 14, and is positioned so that it can slide laterally.

In order that a single labelling machine can be used for the labelling of containers of different formats, some labelling machines may have provided for the individual components, that is, the adhesive units and the labelling box, to be individually mounted on a subframe. In such case, changing to a different format, therefore, necessitates a considerable amount of adjustment work.

Typical bottle labelling machines include Models JOWE-9, JOWE-15, and JOWE-50 manufactured by Johann Weiss of Berlin, West Germany; the KRONES ULTRAMATIC manufactured by Hermann Kronseder of Neutraubling, West Germany; Models ALPHA 45 and ALPHA 60 manufactured by Carl Pirzer GmbH & CO. of Neutraubling, West Germany. The brochures describing Models JOWE-9, JOWE-15, JOWE-50, KRONES ULTRAMATIC, ALPHA 45 and ALPHA 60 are incorporated herein by reference as if the documents were set forth herein in their entirety.

Additionally, bottle labelling machines are disclosed in the following U.S. Patents:

| U.S. PAT. NO. | TITLE |
|---|---|
| 4,283,245 | BOTTLE LABELLING APPARATUS |
| 4,306,926 | BOTTLE LABELING MACHINE AND METHOD |
| 4,430,141 | MACHINE FOR LABELING OBJECTS, ESPECIALLY BOTTLES |
| 4,445,961 | LABELING APPARATUS FOR BOTTLES OR THE LIKE |
| 4,512,842 | LABELING MACHINE |

All of the patents, patent applications, and publications recited herein, if any, are hereby incorporated by reference as if set forth in their entirety herein.

The invention as described hereinabove in the context of a preferred embodiment is not to be taken as limited to all of the provided details thereof, since modifications and variations thereof may be made without departing from the spirit and scope of the invention.

What is claimed is:

1. A labelling machine for attaching a label to a container or the like, said labelling machine comprising:

a rotary turntable, said rotary turntable having means for positioning a container thereon;

a labelling station positioned adjacent the periphery of said rotary turntable;

said labelling station comprising:

a carriage member, said carriage member being translatable with respect to said rotary turntable in a direction towards the periphery of said rotary turntable;

label container means for containing and dispensing a label, said label container means being mounted on said carriage member and translatable in the direction towards the periphery of said rotary turntable therewith; and biasing means for biasing said carriage member in the direction towards the periphery of said rotary turntable;

said labelling machine further comprising:

means for moving a container past said label container means on said rotary turntable in a given direction along a path of travel;

first adhesive applicator means for applying an adhesive to the container;

said first adhesive applicator means being mounted on said carriage member upstream of the direction of travel of the container past said label container means;

second adhesive applicator means for applying an adhesive to the container;

said second adhesive applicator means being mounted on said carriage member downstream of the direction of travel of the container past said label container means;

sensor means for sensing a positioning of the container substantially adjacent said first adhesive applicator means;

said sensor means for activating said first adhesive applicator means in response to the sensing of the substantially adjacent positioning;

adjustable positioning means for adjustably positioning said second adhesive applicator means at a plurality of positions along the path of travel of the container;

a base member mounted substantially adjacent the periphery of said rotary turntable;

said carriage member being mounted on said base member and slidable on said base member in the direction towards the periphery of said rotary turntable;

adjustable stop member means for limiting, at a plurality of positions, the degree of translation of said carriage member towards the periphery of said rotary turntable due to the biasing force exerted by said biasing means;

height adjustment means for positioning and maintaining said carriage member at a plurality of heights with respect to said base member;

tilt adjustment means for adjusting and maintaining a plurality of degrees of relative angular disposition between said carriage member and said base member;

said tilt adjustment means comprising a rail member mounted on one of said carriage member and said base member;

said rail member being rotatably supported by the other of said carriage member and said base member, whereby said carriage member and said base member are rotatably joined to one another;

adjustable set screw means mounted on one of said carriage member and said base member and abutting the other of said carriage member and said base member;

said biasing means comprising a spring member interposed between and abutting both of said carriage member and said base member;

said adjustable positioning means for adjustably positioning said second adhesive applicator;

said second adhesive application comprising an adhesive applicator member slidable mounted on said carriage member; and said adhesive applicator member being slidable with respect to said carriage member in a direction substantially perpendicular to the direction towards the periphery of said rotary turntable.

2. The labelling machine according to claim 1, wherein said spring member comprises a coil spring encircling said rail member, and wherein said stop member means comprises additional adjustable set screw means mounted on one of said carriage member and said base member and abutting the other of said carriage member and said base member.

3. A labelling station for use in conjunction with a labelling machine, the labelling machine being for attaching a label to a vertically oriented container or the like, the labelling machine comprising a rotary turntable having means for positioning a container thereon, said labelling station for being positioned adjacent the periphery of the rotary turntable, said labelling station comprising:

a carriage member;

support means for supporting said carriage member;

said carriage member being movable on said support means toward and away from the periphery of the rotary turntable;

label container means for containing and dispensing a label;

said label container means being mounted on said carriage member;

means for moving said label container means with said carriage member toward and away from the periphery of the rotary turntable;

biasing means for biasing said carriage member toward the periphery of the rotary turntable;

said biasing means being configured for adjusting said label container means to accommodate for variations in the diameters of containers of substantially the same size such that said carriage member is movable away from the periphery of said rotary turntable by a moving container positioned on said rotary turntable;

the container moves past said label container means on the rotary turntable in a given direction along a path of travel, first adhesive applicator means for applying an adhesive to the container, said first adhesive applicator means being mounted on said carriage member upstream of the direction of travel of the container past said label container means;

second adhesive applicator means for applying an adhesive to the container, said second adhesive applicator means being mounted on said carriage member downstream of the direction of travel of the container past said label container means;

sensor means for sensing a positioning of the container substantially adjacent said first adhesive applicator means and for activating said first adhesive applicator means in response to the sensing of the substantially adjacent positioning;

adjustable positioning means for adjustably positioning said second adhesive applicator means at a plurality of positions along the path of travel of the container;

a base member mounted substantially adjacent the periphery of said rotary turntable, said carriage member being mounted on said base member and slidable on said base member in the direction towards the periphery of said rotary turntable;

adjustable stop member means for limiting, at a plurality of positions, the degree of translation of said carriage member towards the periphery of said rotary turntable due to the biasing force exerted by said biasing means;

height adjustment means for positioning and maintaining said carriage member at a plurality of heights with respect to said base member;

tilt adjustment means for adjusting and maintaining a plurality of degrees of relative angular disposition between and carriage member and said base member; and said tilt adjustment means comprising a rail member mounted on one of said carriage member and said base member, said rail member being rotatably supported by the other of said carriage member and said base member, whereby said carriage member and said base member are rotatably joined to one another, and adjustable set screw means mounted on one of said carriage member and said base member and abutting the other of said carriage member and said base member, wherein said biasing means comprises a spring member interposed between and abutting both of said carriage member and said base member, and wherein said adjustable positioning means for adjustably positioning said second adhesive applicator comprises an adhesive applicator member slidably mounted on said carriage member, said adhesive applicator member being slidable with respect to said carriage member in a direction substantially perpendicular to the direction towards the periphery of the rotary turntable.

4. The labelling station according to claim 3, wherein said spring member comprises a coil spring encircling said rail member, and wherein said stop member means comprises additional adjustable set screw means mounted on one of said carriage member and said base member and abutting the other of said carriage member an said base member.

* * * * *

UNITED STATES PATENT AND TRADEMARK OFFICE

CERTIFICATE OF CORRECTION

PATENT NO. : 5,078,826

DATED : January 7, 1992

INVENTOR(S) : Wolfgang ROGALL

It is certified that error appears in the above-identified patent and that said Letters Patent is hereby corrected as shown below:

In column 7, line 43, Claim 1, after 'member', delete "slidable" and insert --slidably--.

In column 10, line 7, delete "an" and insert --and--.

Signed and Sealed this

Thirtieth Day of November, 1993

*Attest:*

*Attesting Officer*

Bruce Lehman

BRUCE LEHMAN

*Commissioner of Patents and Trademarks*